US010696090B2

(12) United States Patent
Takahashi et al.

(10) Patent No.: US 10,696,090 B2
(45) Date of Patent: Jun. 30, 2020

(54) THERMAL TRANSFER LIGHT PEN AND THERMAL TRANSFER APPARATUS

(71) Applicant: Roland DG Corporation, Hamamatsu-shi, Shizuoka (JP)

(72) Inventors: Fumihiro Takahashi, Hamamatsu (JP); Hidetoshi Atsumi, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 230 days.

(21) Appl. No.: 16/008,080

(22) Filed: Jun. 14, 2018

(65) Prior Publication Data

US 2019/0001739 A1 Jan. 3, 2019

(30) Foreign Application Priority Data

Jun. 30, 2017 (JP) ..... 2017-128755

(51) Int. Cl.

| | |
|---|---|
| ***B41J 2/48*** | (2006.01) |
| ***B44C 1/17*** | (2006.01) |
| ***B44C 1/24*** | (2006.01) |
| ***B41J 13/10*** | (2006.01) |
| ***B41J 2/32*** | (2006.01) |
| ***B41M 5/46*** | (2006.01) |
| ***B41J 2/325*** | (2006.01) |
| ***B41F 16/00*** | (2006.01) |

(52) U.S. Cl.

CPC ..... *B44C 1/24* (2013.01); *B41F 16/008* (2013.01); *B41F 16/0046* (2013.01); *B41J 2/32* (2013.01); *B41J 2/325* (2013.01); *B41J 13/10* (2013.01); *B41M 5/46* (2013.01); *B44C 1/1712* (2013.01)

(58) Field of Classification Search

CPC ..... B41F 16/008; B41F 16/0046; B41J 2/32; B41J 2/325; B41J 13/10; B41M 5/46; B41M 5/382; B44C 1/24; B44C 1/1712

See application file for complete search history.

(56) References Cited

U.S. PATENT DOCUMENTS 9,283,687 B2 * 3/2016 Yamanashi ..... G05B 19/409
9,635,923 B2 * 5/2017 Bitoh ..... A45D 29/00

(Continued)

FOREIGN PATENT DOCUMENTS

EP 0 728 342 B1 1/2000
JP 63-242563 * 10/1988 ..... B41J 3/28

(Continued)

*Primary Examiner* — Matthew G Marini
*Assistant Examiner* — Marissa Ferguson-Samreth
(74) *Attorney, Agent, or Firm* — Keating & Bennett, LLP

(57) ABSTRACT

A thermal transfer light pen and a thermal transfer apparatus favorably perform thermal transfer even using light as a heat source to a thermal transfer sheet and performing thermal transfer to a transfer object with an uneven surface. A thermal transfer light pen includes a hollow pen body including a front end portion, a pressing body in the front end portion of the pen body and including a curved surface projecting toward a front end, a light guide including a first end and a second end, at least a portion of the light guide inside the pen body, and a light source connected to the first end of the light guide. The second end of the light guide is disposed in the front end portion of the pen body and faces the pressing body in the pen body. The pressing body is made of a material transparent to light emitted from the light source.

9 Claims, 6 Drawing Sheets

(56) References Cited

U.S. PATENT DOCUMENTS

| | | | | |
|---|---|---|---|---|
| 10,493,759 | B2 * | 12/2019 | Matsumoto | B41M 5/382 |
| 2017/0015058 | A1 * | 1/2017 | Ueda | B29C 64/135 |
| 2019/0160857 | A1 * | 5/2019 | Hayashi | B44C 1/1716 |

FOREIGN PATENT DOCUMENTS

| | | | | | |
|---|---|---|---|---|---|
| JP | 63-242563 | A | | 10/1988 | |
| JP | 07-237308 | A | | 9/1995 | |
| JP | 2003-80663 | | * | 3/2003 | G03F 7/24 |
| JP | 2004-355007 | | * | 12/2004 | G02B 26/10 |
| JP | 2013-220536 | A | | 10/2013 | |
| JP | 2016-215599 | | * | 12/2016 | B41J 2/48 |
| JP | 2016-215599 | A | | 12/2016 | |
| JP | 2018-144089 | | * | 3/2017 | B23K 26/00 |

* cited by examiner

THERMAL TRANSFER LIGHT PEN AND THERMAL TRANSFER APPARATUS

CROSS REFERENCE TO RELATED APPLICATIONS

This application claims the benefit of priority to Japanese Patent Application No. 2017-128755 filed on Jun. 30, 2017. The entire contents of this application are hereby incorporated herein by reference.

BACKGROUND OF THE INVENTION

1. Field of the Invention

The present invention relates to a thermal transfer light pen and a thermal transfer apparatus. More specifically, the present invention relates to a thermal transfer light pen and a thermal transfer apparatus that perform transfer onto a transfer object using a thermal transfer sheet.

2. Description of the Related Art

A decorative process by a thermal transfer method has been performed to date by using a thermal transfer sheet (also called transfer foil, for example) for the purpose of enhancing aesthetic design. The thermal transfer sheet is generally constituted by stacking a base material, a decorative layer, and an adhesive layer in this order. In thermal transfer, a thermal transfer sheet is overlaid on a transfer object to bring its adhesive layer into contact with the transfer object, and the sheet is pressed with a heated thermal stylus from above (hot stamping). Accordingly, the adhesive layer is melted with a pressing body on the thermal transfer sheet to be attached to the surface of the transfer object and then cured by heat dissipation. Consequently, the thermal transfer sheet (base material) is separated from the transfer object, and thereby, the decorative layer having a shape conforming to a portion subjected to the hot stamping can be attached to the transfer object together with the adhesive layer. Accordingly, decoration with any intended design is made on the surface of the transfer object.

Japanese Patent Application Publication No. 2013-220536, for example, discloses such a thermal transfer method performed by using a thermal transfer apparatus including a thermal stylus and scanning with the thermal stylus automatically based on data concerning a thermal transfer shape.

In a conventional thermal transfer method, in general, the thermal transfer sheet is pressed by a heated thermal stylus to directly heat the thermal transfer sheet. On the other hand, in some recent methods, a laser pen that emits laser light from a pen nib is used for heating and pressing a thermal transfer sheet. That is, the laser pen uses laser light as a heat source and converts optical energy to thermal energy and achieves thermal transfer. The pen nib of the laser pen is constituted by a flat member such as a glass plate in order to reduce refraction and scattering of laser light and maintain a straight-traveling property of laser light (see, for example, Japanese Patent Application Publication No. 2016-215599).

The laser pen having such a pen nib is suitably used in the case of transfer to a transfer object having, for example, a flat surface or a curved surface obtained by bending a flat surface into a gently convex shape (typically an arch-shaped surface such as a columnar surface). In a case where the transfer target surface has unevenness or tilts relative to the laser pen, however, the pen nib cannot sufficiently contact the transfer target surface, which causes a failure in performing desired hot stamping by uniformly pressing a thermal transfer sheet onto the transfer target surface.

SUMMARY OF THE INVENTION

Preferred embodiments of the present invention provide thermal transfer light pens and thermal transfer apparatuses that favorably perform thermal transfer even in the case of using light as a heat source to a thermal transfer sheet and performing thermal transfer to a transfer object having an uneven surface. A thermal transfer light pen according to a preferred embodiment of the present invention includes: a hollow pen body including a front end portion; a pressing body disposed in the front end portion of the pen body and including a curved surface projecting toward a front end; a light guide including a first end and a second end, at least a portion of the light guide being disposed inside the pen body; and a light source connected to the first end of the light guide. The second end of the light guide is disposed in the pen body and faces the pressing body at the front end portion of the pen body, and the pressing body is made of a material transparent to light emitted from the light source.

The thermal transfer light pen enables the pressing body and the transfer object to contact with each other in a smaller area in a light pen of a type that heats a transfer object by supplying optical energy to the transfer object without directly heating the pressing body. Accordingly, in the case of thermal transfer to a transfer object having an uneven or tilted surface, for example, a recessed portion or a tilted portion of the transfer object is able to be pressed by the pressing body so that variations in transfer are reduced or prevented. In addition, the transfer object is able to be pressed in a narrower line width. As a result, a thermal transfer light pen that reduces transfer variations and favorably performs delicate thermal transfer different from that of a conventional light pen is achieved.

A thermal transfer apparatus according to a preferred embodiment of the present invention includes: the thermal transfer light pen described above; a placing table on which a transfer object is placed; a conveyor that moves the placing table and the thermal transfer light pen relative to each other; and a controller that is connected to the light source provided in the thermal transfer light pen and the conveyor to enable communication with the light source and the conveyor and drives the light source and the conveyor. The controller causes the thermal transfer light pen and the placing table to be moved relative to each other by the conveyor so that the pressing body of the thermal transfer light pen is pressed against the transfer object and to supply light from the light source of the thermal transfer light pen onto the transfer object.

The thermal transfer apparatus includes the thermal transfer light pen described above. Thus, the use of this thermal transfer apparatus is able to automatically perform thermal transfer by the thermal transfer light pen. Accordingly, based on previously prepared scanning data, for example, scanning with the thermal transfer light pen is able to be performed. In addition, delicate thermal transfer with reduced transfer variations different from that of a conventional light pen is able to be repeatedly favorably performed.

A preferred embodiment of the present invention provides a thermal transfer light pen and a thermal transfer apparatus that are able to favorably perform thermal transfer with reduced transfer variations in a case where light is used as a heat source to a thermal transfer sheet and thermal transfer is performed on a transfer object including an uneven surface.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
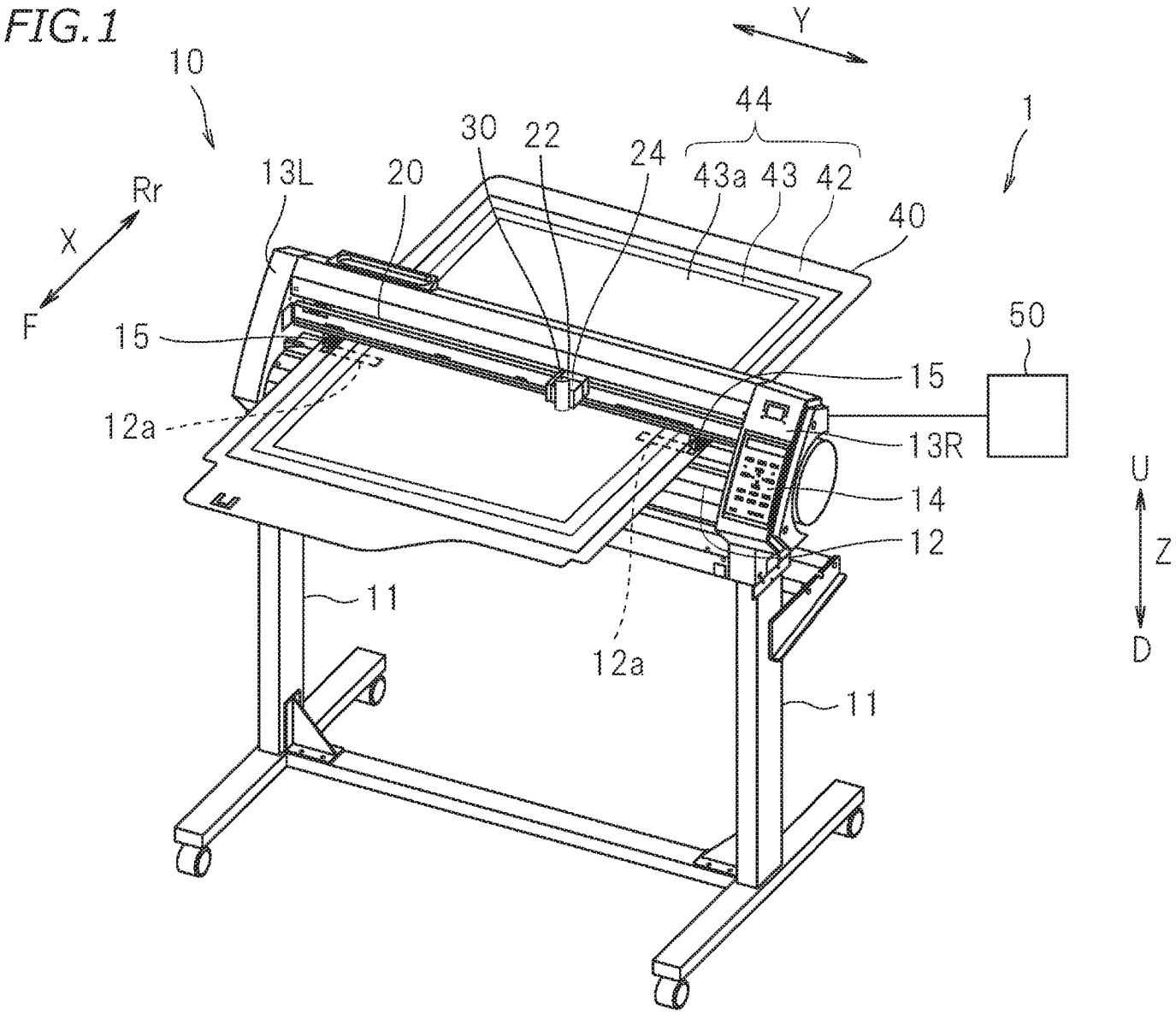
FIG. 1 is a perspective view schematically illustrating a thermal transfer apparatus for use in a foil transfer method according to a preferred embodiment of the present invention.

Preferred embodiments of the present invention will be described hereinafter with reference to the drawings. The preferred embodiments described here are, of course, not intended to particularly limit the present invention. Elements and features having the same functions are denoted by the same reference numerals, and description for the same elements and features will not be repeated or will be simplified as appropriate.

FIG. 1 is a perspective view illustrating a thermal transfer apparatus 1 according to a preferred embodiment of the technique disclosed here. In the accompanying drawings, character Y represents a main scanning direction. Character X represents a sub-scanning direction perpendicular or substantially perpendicular to the main scanning direction Y. Character Z represents a vertical direction. Characters F, Rr, U, and D represents front, rear, up, and down, respectively. It should be noted that these directions are defined simply for convenience of description, and do not limit the state of installation of the thermal transfer apparatus 1. The directions can be appropriately set depending on the state of the thermal transfer apparatus 1.

The thermal transfer apparatus 1 is an apparatus that provides a decorative layer in a thermal transfer sheet 43 to the surface of a transfer object 42 by heating and pressing the transfer object 42 with the thermal transfer sheet 43 overlaid thereon. With some combinations of the transfer object 42 and the thermal transfer sheet 43, a light absorbing sheet 43*a* described later can be used together with the thermal transfer sheet 43. In the following description, targets of "heating and pressing", such as the transfer object 42, the thermal transfer sheet 43, and the light absorbing sheet 43*a*, can be collectively referred to as a process object 44 in some cases.

The thermal transfer apparatus 1 includes an apparatus body 10, two stands 11 supporting the apparatus body 10, and a controller 50. The apparatus body 10 extends in the main scanning direction Y. The apparatus body 10 includes a base 12, a left wall 13L, a right wall 13R, a guide rail 20, and a placing table 40. The base 12 is fixed to the stands 11. The base 12 extends in the main scanning direction Y. The left wall 13L is disposed at the left end of the base 12 and defines a left wall of the apparatus body 10. The right wall 13R is disposed at the right end of the base 12 and defines a right wall of the apparatus body 10. The guide rail 20 is fixed to the left wall 13L and the right wall 13R. The guide rail 20 extends in the main scanning direction Y. The left wall 13L and the right wall 13R are perpendicular or substantially perpendicular to the base 12 and the guide rail 20. The right wall 13R is provided with an operation panel 14.

The base 12 is provided with a plurality of cylindrical grit rollers 12*a*. The plurality of grit rollers 12*a* are buried in the base 12 with their cylindrical surfaces exposed upward. The grit rollers 12*a* are electrically connected to an X-axis feed motor (not shown). The X-axis feed motor is controlled by the controller 50. Pinching rollers 15 are disposed above the grit rollers 12*a*. The pinching rollers 15 face the grit rollers 12*a*. The placing table 40 is interposed between the grit rollers 12*a* and the pinching rollers 15. The process object 44 including the transfer object 42 and the thermal transfer sheet 43 is placed on the placing table 40. The pinching rollers 15 set a position in the Z-axis direction depending on the process object 44 placed on the placing table 40. The grit rollers 12*a* and the pinching rollers 15 convey the process object 44 in the sub-scanning direction X together with the placing table 40. The grit rollers 12*a*, the pinching rollers 15, and the X-axis feed motor are an example of an X-axis conveyor that moves the process object 44 in the sub-scanning direction X.

The guide rail 20 is disposed above the base 12. A carriage 22 is engaged with the guide rail 20. A portion of a drive wire (not shown) extended in the main scanning direction Y is fixed to a rear Rr-side surface of the carriage 22. The drive wire is electrically connected to a Y-axis scanning motor (not shown). The Y-axis scanning motor is controlled by the controller 50. When the Y-axis scanning motor is driven, the drive wire is moved in the main scanning direction Y. The carriage 22 is movable along the guide rail 20 in the main scanning direction Y in accordance with movement of the drive wire. A thermal transfer tool 30 is disposed at a front F-side surface of the carriage 22 with a vertical slider mechanism 24 interposed therebetween. The guide rail 20, the carriage 22, the drive wire, and the Y-axis scanning motor are an example of a Y-axis conveyor that moves the thermal transfer tool 30 in the main scanning direction Y.

The vertical slider mechanism 24 is mounted on the carriage 22. The vertical slider mechanism 24 is a linear conveyor including a ball screw (not shown), a fixed feed nut (not shown), a nut rotating motor (not shown), and a holding mechanism (not shown). The ball screw is disposed to have its screw axis coincide with the vertical direction Z. The holding mechanism to hold the thermal transfer tool 30 is connected to the ball screw. The fixed feed nut is fitted on (screwed to) the ball screw with a screw structure. The fixed feed nut is rotatably fixed to the carriage 22. The nut rotating motor is connected to the fixed feed nut. The nut rotating motor rotates the fixed feed nut in a forward direction or a reverse direction so that the ball screw slides without rotation upward U or downward D. Accordingly, the position of the thermal transfer tool 30 in the vertical direction Z is able to be moved upward U or downward D. The vertical slider mechanism 24 is an example of a Z-axis direction conveyor that moves the thermal transfer tool 30 in the Z-axis direction.

Figure 2:
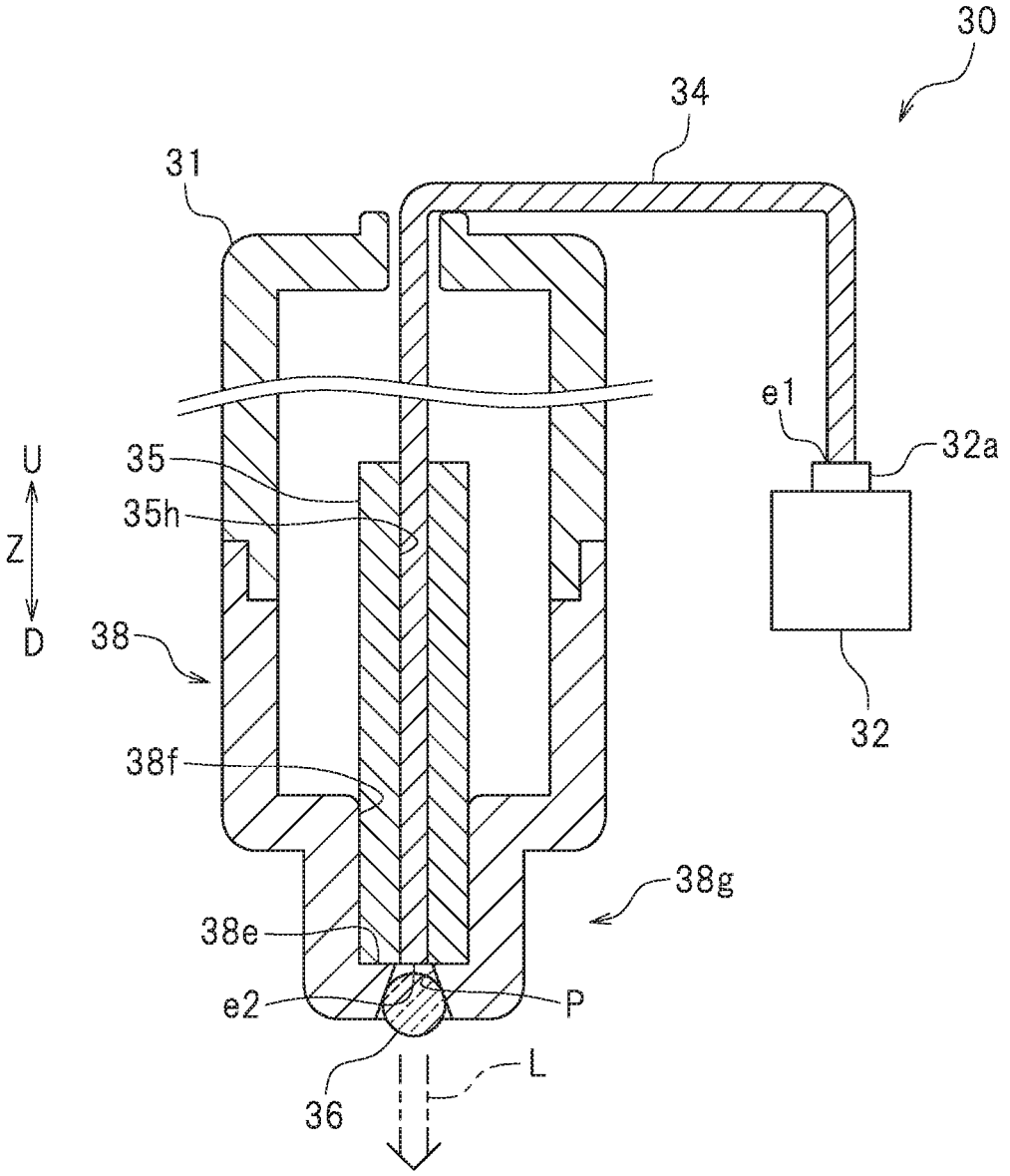
FIG. 2 is a cross-sectional view schematically illustrating a configuration of a thermal transfer light pen according to a preferred embodiment of the present invention.

FIG. 2 is a cross-sectional view schematically illustrating the thermal transfer tool 30 according to the present preferred embodiment. The thermal transfer tool 30 is mounted on the carriage 22 and is disposed above the placing table 40. The thermal transfer tool 30 includes a light source 32, a pen body 31, and a pressing body 36 fixed to a downward D end of the pen body 31.

The light source 32 supplies light serving as a heat source to the process object 44. The light source 32 is mounted on the carriage 22. Light supplied to the process object 44 is converted to thermal energy and heats the process object 44. The light source 32 according to this preferred embodiment is a laser oscillation device including a laser diode (LD) and an optical system, for example. The light source 32 is connected to the controller 50. The controller 50 controls switching of laser light from the light source 32 between emission (on) and stop (off), a laser output, and so forth. Laser light has high response speed, and thus, not only switching between irradiation and non-irradiation of light but also a change in, for example, the output is able to be instantaneously performed. Accordingly, laser light having desired properties are able to be emitted.

The pen body 31 has a long cylindrical shape. The pen body 31 is disposed to have its longitudinal direction coincide with the vertical direction Z. The pen body 31 has a center axis coincide with the vertical direction Z. The pen body 31 houses an optical fiber 34 and a ferrule 35. A lower end of the pen body 31 is provided with a holder 38 described later.

The optical fiber 34 is a fibrous optical transmission medium that transmits light emitted from the light source 32. The optical fiber 34 includes a core portion (not shown) allowing light to pass therethrough and a cladding portion (not shown) surrounding the core portion and reflecting light. The optical fiber 34 is connected to the light source 32. The optical fiber 34 has an end e1 at the upward U side that extends outward from the pen body 31. The end e1 of the optical fiber 34 is inserted in a connector 32*a* attached to the light source 32. With this configuration, the optical fiber 34 is connected to the light source 32 with a small optical loss. The optical fiber 34 has an end e2 at the downward D side that is equipped with the ferrule 35. The ferrule 35 is a cylindrical member for photojunction. The ferrule 35 has a through hole 35*h* extending along the cylinder axis. The end e2 of the optical fiber 34 is inserted in the through hole 35*h* of the ferrule 35. Accordingly, the center axis of the end e2 of the optical fiber 34 can coincide with the cylinder axis of the ferrule 35. The optical fiber 34 and the ferrule 35 are an example of a light guide according to a preferred embodiment of the present invention.

The pen body 31 includes a front end portion at the downward D side provided with the holder 38. The holder 38 is a holding member that holds the ferrule 35 at a predetermined position at the lower end of the pen body 31. The holder 38 has a cap shape. The shape of an upper portion of the holder 38 is a cylinder whose outer diameter conforms to the pen body 31. A lower portion of the holder 38 has a cylindrical projecting portion 38*g* (see FIG. 2) whose outer diameter is smaller than that of the pen body 31.

The projecting portion 38*g* of the holder 38 includes, at an upward U side, a ferrule holding portion 38*f* that is a cylindrical recessed portion. The ferrule holding portion 38*f* has an inner diameter conforming to the outer diameter of the ferrule 35. The lower end of the ferrule 35 is housed in the ferrule holding portion 38*f*. The optical fiber 34 and the ferrule 35 are generally fabricated based on an international standard (IEC 61755-3-1:2006). The ferrule holding portion 38*f* is designed in conformity with this standard to allow the ferrule 35 to be fitted therein and fixed thereto. In consideration of holding property and gripping power of the ferrule 35 of the ferrule holding portion 38*f*, the holder 38 is preferably made of an elastic material. The holder 38 is made of, for example, a resin material. The material for the holder 38 is, for example, polyacetal.

The ferrule holding portion 38*f* includes a bottom portion 38*e* that restricts the depth of the recessed portion (the dimension in the vertical direction Z). The bottom portion 38*e* has an aperture P penetrating the bottom portion 38*e* in the vertical direction Z. The core portion of the end e2 of the optical fiber 34, the ferrule holding portion 38*f*, and the aperture P are arranged on the same axis O (see FIGS. 3D and 3E). Accordingly, the holder 38 does not interfere with an optical path L of laser light. Consequently, laser light emitted from the light source 32 is able to be emitted to the outside from the lower end of the pen body 31. In addition, the holder 38 can house the end e2 of the optical fiber 34 at a predetermined position. Consequently, the optical path L of laser light emitted from the lower end of the pen body 31 is fixed at a predetermined position.

The holder 38 is a member that holds the pressing body 36 at a predetermined position at the lower end of the pen body 31. First, the pressing body 36 will be described. The pressing body 36 is a member that presses the process object 44. The pressing body 36 is made of a hard material. The pressing body 36 is not specifically limited to a specific hardness, and is made of a material having a Vickers hardness of 100 $Hv_{0.2}$ or more (e.g., 500 $Hv_{0.2}$ or more), for example. The holder 38 holds the pressing body 36 on the optical path L of laser light applied from the end e2 of the optical fiber 34. The pressing body 36 is made of a material transparent to light emitted from the light source 32. Accordingly, even in a case where the pressing body 36 is disposed on the optical path L of laser light, the laser light passes through the pressing body 36. As a result, laser light emitted from the light source 32 is supplied to the process object 44 without being blocked by the pressing body 36. The pressing body can be made of, for example, glass. The pressing body 36 according to this preferred embodiment is made of synthetic quartz glass.

In this specification, the term "transparent" for a material of the pressing body 36 with respect to light indicates that an interaction that causes a problem in supply of light (optical energy) to the process object 44 does not occur between the light and the material. The term "transparent" indicates that a transmittance of the light to the pressing body 36 is about 50% or more, preferably about 70% or more, more preferably about 80% or more, and especially preferably about 85% or more (e.g., about 90% or more). The transmittance refers to a transmittance including a surface reflection loss of a sample having a predetermined thickness (e.g., about 10 mm) measured in conformity with JIS R3106:1998, for example.

Figure 3A:
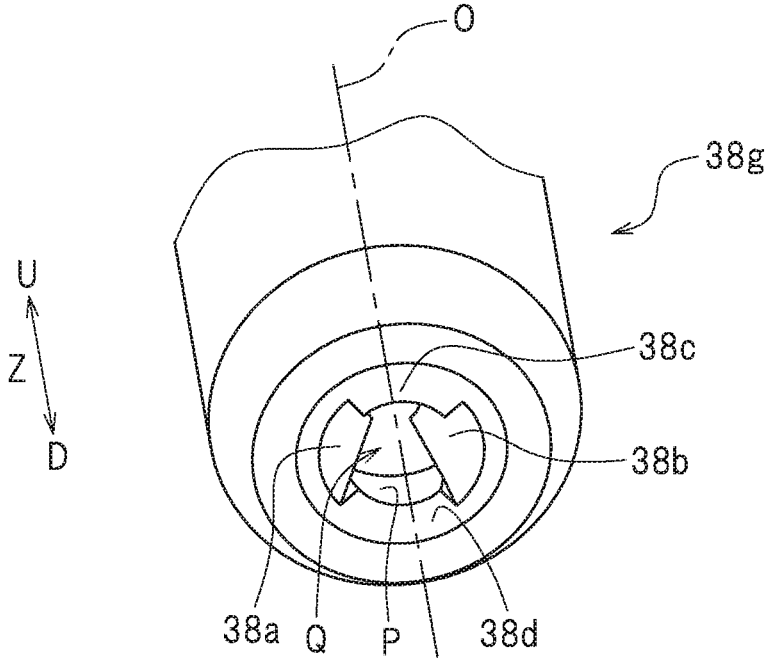
FIG. 3A is a perspective view schematically illustrating a configuration of a front end portion of a holder according to a preferred embodiment of the present invention.
Figure 3B:
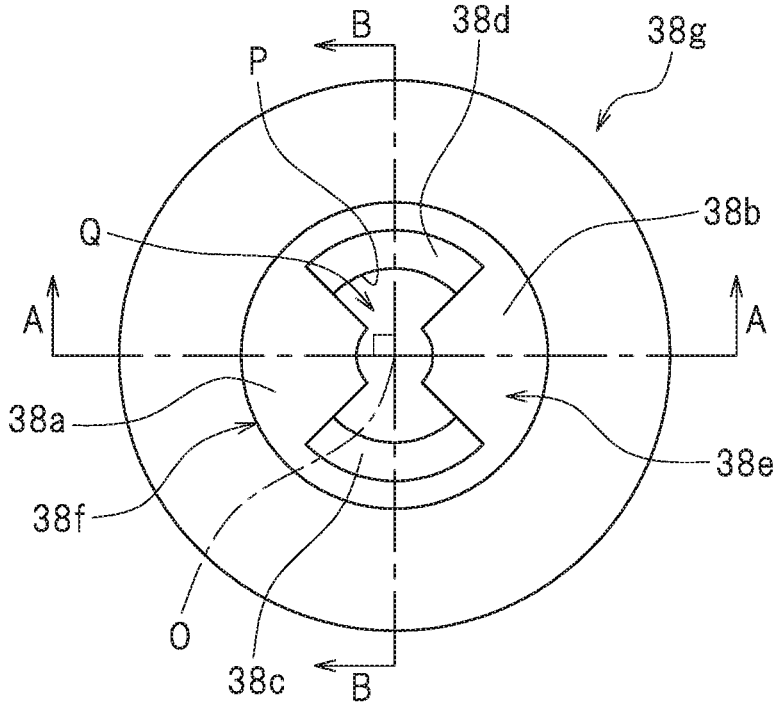
FIG. 3B is a top view of a projecting portion at the front end of the holder illustrated in FIG. 3A.
Figure 3C:
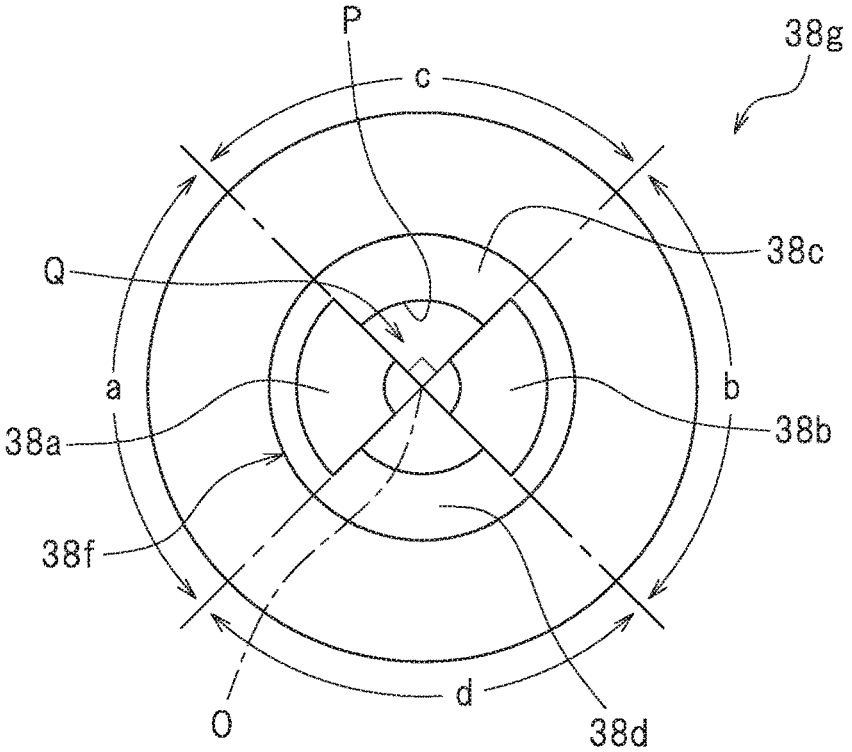
FIG. 3C is a bottom view of the projecting portion at the front end of the holder illustrated in FIG. 3A.
Figure 3D:
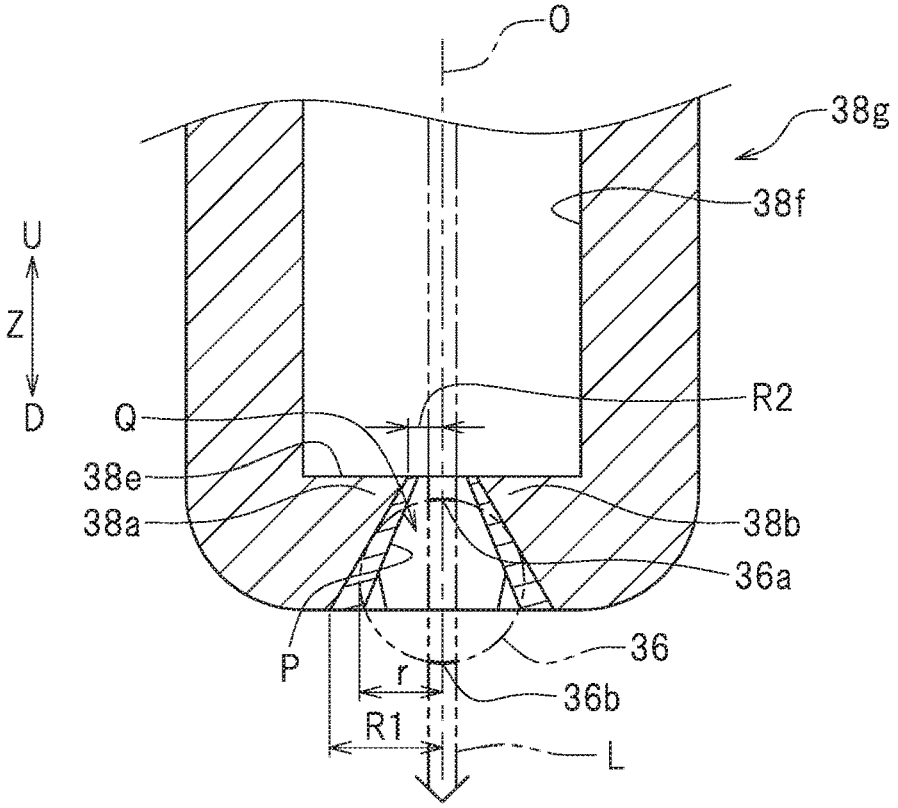
FIG. 3D is a cross-sectional view of the projecting portion at the front end of the holder illustrated in FIG. 3B taken along line A-A.
Figure 3E:
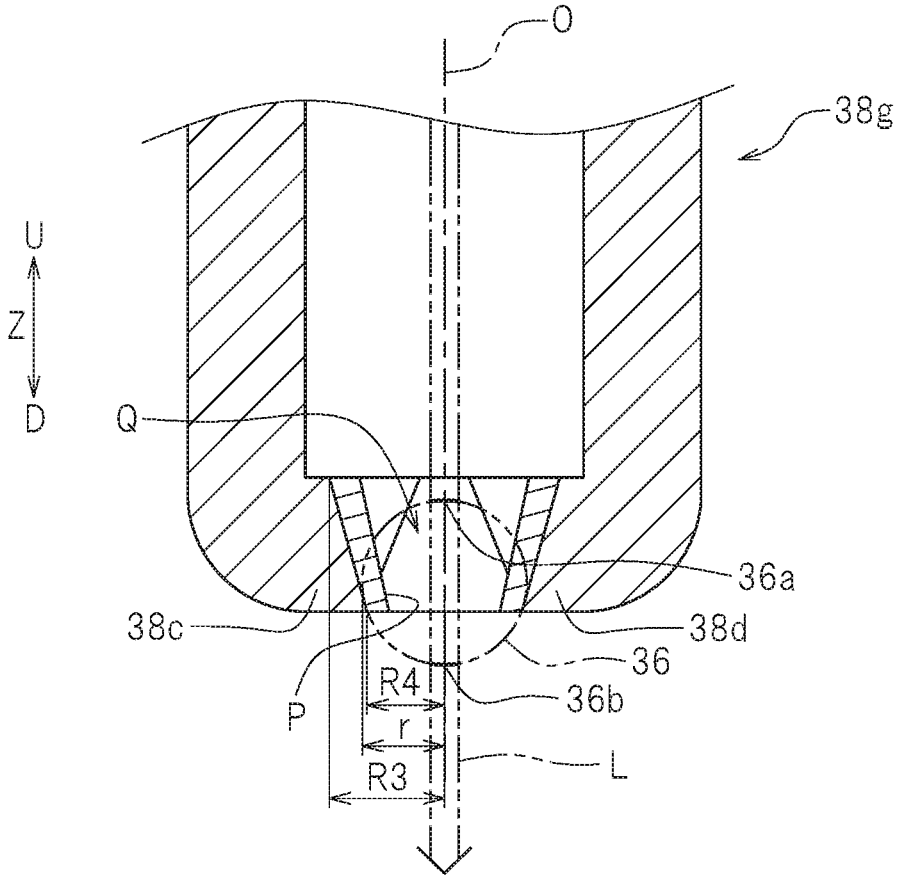
FIG. 3E is a cross-sectional view of the projection portion at the front end of the holder illustrated in FIG. 3B taken along line B-B.

The pressing body 36 includes a light entrance portion 36*a* and a light exit portion 36*b* (see FIGS. 3D and 3E). The light entrance portion 36*a* is a portion of the surface of the pressing body 36, and this portion receives laser light applied from the end e2 of the optical fiber 34. The light exit portion 36*b* is a portion of the surface of the pressing body 36, and from this portion, laser light that has passed through the inside of the pressing body 36 is emitted to the outside. The pressing body 36 includes a curved surface that is a portion of a surface including at least the light exit portion 36*b* and projecting from the light entrance portion 36*a* toward the light exit portion 36*b*. A curvature of the curved surface of light exit portion 36*b* is not limited to a specific value. A curvature radius of the curved surface of the light exit portion 36*b* can be, for example, about 0.5 or more and about 1 mm or less. The pressing body 36 according to this preferred embodiment preferably is a sphere having a diameter of about 1.5 mm, for example. Thus, the light exit portion 36*b* has a hemispherical surface. In a case where the pressing body 36 is a sphere that does not have directivity, properties of the sphere does not change even when the sphere rotates with the center thereof maintained. Thus, in a case where the pressing body 36 is a homogeneous sphere, a portion of the optical fiber 34 opposite to the end e2 of the optical fiber 34 can be defined as the light entrance portion 36*a*. With respect to the light entrance portion 36*a*, a portion in point symmetry about the center of the sphere can be defined as the light exit portion 36*b*.

FIG. 3A is a perspective view illustrating the cylindrical projecting portion 38*g* at the lower end of the holder 38 according to the preferred embodiment. FIGS. 3B and 3C are a top view and a bottom view, respectively, when the projecting portion 38*g* of the holder 38 is seen in the vertical direction Z. In FIG. 3B, line A-A and line B-B are lines passing through the center (center axis O) of the projecting portion 38*g*. Line A-A and line B-B are perpendicular or substantially perpendicular to each other. With reference to FIGS. 3B and 3C, the direction toward the center O of the projecting portion 38*g* will be hereinafter referred to as a radial direction. FIG. 3D is a cross section taken along line A-A in FIG. 3B. FIG. 3E is a cross section taken along line B-B in FIG. 3B. FIGS. 3D and 3E illustrate the optical path L and the pressing body 36 held in the holder 38 by chain double-dashed lines. The center axis of the pen body 31 according to this preferred embodiment may coincide with, but is not limited to, the center axis O.

The bottom portion 38*e* of the projecting portion 38*g* holds the pressing body 36. The bottom portion 38*e* has the aperture P penetrating the bottom portion 38*e* in the vertical direction Z as described above. The aperture P defines a space Q in the bottom portion 38*e*. The space Q is surrounded by the inner wall. The aperture P is the inner wall surrounding the space Q. A portion of the pressing body 36 is housed in the space Q. The pressing body 36 is in contact with the aperture P. Accordingly, movement of the pressing body 36 in the vertical direction Z, the longitudinal direction X, and the lateral direction Y in the space Q are restricted. In other words, the position of the pressing body 36 in the space Q is fixed by contact with the aperture P. The aperture P preferably has a cylindrical shape, for example. The cylindrical shape has a radius larger than a radius r of the spherical pressing body 36. In order to contact the pressing body 36, the aperture P has a projecting wall portion projecting from the cylinder position toward the center axis O.

As illustrated in FIGS. 3B and 3D, a pair of projecting wall portions 38*a* and 38*b* radially projecting toward the center O from the wall surface (not shown) of the cylinder having a radius R1 is provided in an upper U portion of the bottom portion 38*e* in the thickness direction (vertical direction Z). The projecting wall portions 38*a* and 38*b* restrict movement of the pressing body 36 housed in the space Q upward U without interference with the optical path L of laser light. The projecting wall portions 38*a* and 38*b* are disposed in two regions a and b in four regions a, b, c, and d obtained by dividing the circular bottom portion 38*e* by two lines passing through the center O and intersecting each other at 90 degrees in plan view (see FIG. 3C). As illustrated in FIG. 3D, the projecting wall portions 38*a* and 38*b* are structured such that the projection length from the wall surface of the cylinder having the radius R1 gradually increases from a downward D side to an upward U side in the thickness direction of the bottom portion 38*e*. The projecting wall portions 38*a* and 38*b* included tilted portions (are tapered) so that the space Q becomes narrower from the downward D side D to the upward U side. The tilted portions are provided across the entire thickness of the bottom portion 38*e*.

A circular opening with a radius R2 is located in the uppermost surface of the bottom portion 38*e* between the projecting wall portion 38*a* and the projecting wall portion 38*b*. A dimension of each of the projecting wall portions 38*a* and 38*b* at the uppermost surface of the bottom portion 38*e* is (R1−R2). At the uppermost surface of the bottom portion 38*e*, the distance between the projecting wall portion 38*a* and the projecting wall portion 38*b* is expressed as (2×R2). The radius R2 is set in such a manner that the distance (2×R2) between the projecting wall portion 38*a* and the projecting wall portion 38*b* at the uppermost surface is smaller than a diameter 2*r* of the pressing body 36. The radius R2 is designed in such a manner that the distance (2×R2) between the projecting wall portion 38*a* and the projecting wall portion 38*b* is larger than the optical path L (spot diameter) of laser light passing through the center O. A radial dimension of the projecting wall portions 38*a* and 38*b* at the lowermost surface of the bottom portion 38*e* is smaller than (R1−R2) and smaller than (R1−r). The radial dimension of the projecting wall portions 38*a* and 38*b* at the lowermost surface in this preferred embodiment is, for example, zero. The projecting wall portions 38*a* and 38*b* are structured such that the radial distance between these portions from the uppermost surface to the lowermost surface gradually increases from (2×R2) to (2×R1). For example, the projecting wall portions 38*a* and 38*b* define a portion of a side surface (tilted surface) of a truncated cone whose upper surface has the radius R2 and lower surface has the radius R1. The projecting wall portions 38*a* and 38*b* are an example of a first projecting wall whose inner diameter increases toward the front end portion of the pen body 31.

As illustrated in FIGS. 3C and 3E, a pair of projecting wall portions 38*c* and 38*d* projecting toward the center O from the wall surface of a cylinder having a radius R3R is provided in a lower portion of the bottom portion 38*e* in the thickness direction (vertical direction Z). The radius R3 and the radius R1 may be equal or different from each other. The projecting wall portions 38*c* and 38*d* restrict movement of the pressing body 36 housed in the space Q downward D without interference with the optical path L of laser light. The projecting wall portions 38*c* and 38*d* are disposed in the two regions c and d in the four regions a, b, c, and d obtained by dividing the circular bottom portion 38*e*. As illustrated in FIG. 3E, the projecting wall portions 38*c* and 38*d* are structured such that a projection dimension from the wall surface of a cylinder having a radius R3 gradually increases downward D. The projecting wall portions 38*c* and 38*d* include tilted portions (are tapered) so that the space Q becomes narrower downward D. The tilted portions are provided across the entire thickness of the bottom portion 38*e*.

A circular opening having a radius R4 is located in the lowermost surface of the bottom portion 38*e* between the projecting wall portion 38*c* and the projecting wall portion 38*d*. A radial dimension of each of the projecting wall portions 38*c* and 38*d* at the lowermost surface of the bottom portion 38*e* is (R3−R4). At the lowermost surface of the bottom portion 38*e*, the distance between the projecting wall portion 38*c* and the projecting wall portion 38*d* is expressed as (2×R4). The radius R4 is set in such a manner that the distance (2×R4) between the projecting wall portion 38*c* and the projecting wall portion 38*d* is smaller than a diameter 2*r* of the pressing body 36. The radius R4 is designed in such a manner that the distance (2×R4) between the projecting wall portion 38*c* and the projecting wall portion 38*d* is larger than the optical path L (spot diameter) of laser light passing through the center O. A radial dimension of the projecting wall portions 38*c* and 38*d* at the uppermost surface of the bottom portion 38*e* is smaller than (R3−R4) and smaller than (R3−r). The radial dimension of the projecting wall portions 38*c* and 38*d* at the uppermost surface in this preferred embodiment is, for example, zero. The projecting wall portions 38*c* and 38*d* are structured such that the radial distance between these portions from the uppermost surface to the lowermost surface gradually decreases from (2×R3) to (2×R4). For example, the projecting wall portions 38*c* and 38*d* define a portion of a side surface (tilted surface) of a truncated cone whose upper surface has a radius R3 and lower surface has a radius R4. The projecting wall portions 38*c* and 38*d* are an example of a second projecting wall whose inner diameter decreases toward the front end of the pen body 31.

In this preferred embodiment, the arc surface of the pressing body 36 is in contact with each of the projecting wall portions 38*a* and 38*b*. The projecting wall portions 38*a* and 38*b* face each other in the line A-A direction. Accordingly, movement of the pressing body 36 in the line A-A direction is restricted by the projecting wall portions 38*a* and 38*b*. The arc surfaces of the pressing body 36 are in contact with each of the projecting wall portions 38*c* and 38*d*. The projecting wall portions 38*c* and 38*d* face each other in the line B-B direction. Accordingly, movement of the pressing body 36 in the line B-B direction is restricted by the projecting wall portions 38*c* and 38*d*.

Dimensions of the holder 38 are adjusted so that at least the light exit portion 36*b* of the pressing body 36 projects downward D from the lowermost surface of the bottom portion 38*e*. Specifically, the projection dimension (R3−R4) of the projecting wall portions 38*c* and 38*d* is smaller than the projection dimension (R1−R2) of the projecting wall portions 38*a* and 38*b*. The projection dimensions (R1−R2) and (R3−R4) of the projecting wall portions 38*a*, 38*b*, 38*c*, and 38*d*, the thickness of the bottom portion 38*e*, and the taper angles of the projecting wall portions 38*a*, 38*b*, 38*c*, and 38*d*, for example, are adjusted so that the light exit portion 36*b* of the pressing body 36 projects downward D from the lowermost surface of the bottom portion 38*e*. Accordingly, laser light emitted from the light source 32 penetrates through the inside of the thermal transfer tool 30 through the optical fiber 34 to be guided to the light exit portion 36*b* of the pressing body 36 at the lower end of the thermal transfer tool 30. The thermal transfer tool 30 is able to supply light from the light exit portion 36*b* of the pressing body 36 to the process object 44, and to contact the process object 44.

The pressing body 36 enables pressing of the surface of the process object 44. Specifically, the thermal transfer tool 30 is held and is slidable in the Z-axis direction by a holding mechanism mounted on the carriage 22. The thermal transfer tool 30 includes a solenoid electromagnetic actuator (not shown) and a spring (not shown). The electromagnetic actuator is controlled by the controller 50. When a current is caused to flow by the controller 50, a driving force thereof causes the thermal transfer tool 30 to instantaneously project downward D. Accordingly, the thermal transfer tool 30 contacts the process object 44. At this time, an electromagnetic force generated by the solenoid is controlled so that a pressing force to the process object 44 is able to be adjusted. The spring is disposed below the electromagnetic actuator. The spring biases the thermal transfer tool 30 upward U. When a current that is to flow in the solenoid is stopped, the thermal transfer tool 30 moves upward U by the biasing force of the spring. Accordingly, the thermal transfer tool 30 is separated from the process object 44. The electromagnetic actuator and the spring are an example of the Z-axis direction conveyor that moves the thermal transfer tool 30 in the Z-axis direction.

The overall operation of the thermal transfer apparatus 1 is controlled by the controller 50. The controller 50 is connected to the X-axis feed motor, the Y-axis scanning motor, the light source 32, and the electromagnetic actuator to enable communication with these components. The controller 50 is typically a computer. The controller 50 drives the X-axis feed motor and the Y-axis scanning motor so that the process object 44 and the thermal transfer tool 30 move relative to each other. The controller 50 drives the electromagnetic actuator so that the pressing body 36 of the thermal transfer tool 30 is brought into contact with and pressed against the surface of the process object 44. The controller 50 drives the light source 32 to apply light from the pressing body 36 of the thermal transfer tool 30 to the process object 44.

The thermal transfer apparatus 1 transfers foil onto the surface of the transfer object 42 by applying heat and pressure to the process object 44. Specifically, a user first prepares the thermal transfer tool 30. Here, the thermal transfer apparatus 1 including the thermal transfer tool 30 is prepared. Thereafter, an unillustrated host computer and the thermal transfer apparatus 1 are connected together, and power of the host computer is turned on. From the operation panel 14, power of the thermal transfer apparatus 1 is turned on. A storage of the host computer stores a program or programs for thermal transfer.

Next, the user prepares, as the process object 44, a transfer object 42 that is an object of thermal transfer and a thermal transfer sheet 43 for transfer onto the transfer object 42. The transfer object 42 is not limited to a specific object. Examples of the transfer object 42 include papers such as plain paper, drawing paper, and Japanese paper, fabrics, resins such as acrylic, polyvinyl chloride, polyester, polyethylene terephthalate, and polycarbonate, rubbers, leathers, metals, glasses, ceramics. The decorated surface of the transfer object 42 made of one of these materials may be subjected to a pretreatment such as a roughening treatment or addition of an adhesive layer.

The thermal transfer sheet 43 may be, but is not limited to, transfer foil that is commercially available for thermal transfer as, for example, hot stamping foil. The thermal transfer sheet 43 is typically a stack of a base material, a decorative layer, and an adhesive layer in this order. A decorative layer in hot stamping foil include, for example, metallic foil such as gold foil or sliver foil, half metallic foil, pigment foil, multi-color printing foil, hologram foil, or electrostatic destruction measures foil. With some configurations of the thermal transfer sheet 43 to be used, the thermal transfer sheet 43 can have no light absorbing property or low light absorbing property to light emitted from the light emitted from the light source 32. In such a case, the user overlays a light absorbing sheet 43*a* on the upper surface of the thermal transfer sheet 43 when necessary so that the resulting sheets are able to be used as the process object 44. The light absorbing sheet 43*a* is a sheet that efficiently absorbs a predetermined wavelength band (laser light) emitted from the light source 32 of the thermal transfer tool 30 and is capable of converting the light to thermal energy.

Thereafter, the user operates the host computer connected to the thermal transfer apparatus 1 to instruct execution of a program for thermal transfer. The program for thermal transfer is configured in such a manner that when the user inputs data of characters, symbols, patterns, and so forth (hereinafter simply referred to as a "pattern") to be subjected to thermal transfer, based on this data, the program for thermal transfer generates thermal transfer data. The data on patterns, for example, input by the user is expressed in a vector format, for example. The input data of pattern, for example, is converted to thermal transfer data. The thermal transfer data is expressed by, for example, a raster data format. The thermal transfer data is output to the controller 50 of the thermal transfer apparatus 1.

The controller 50 executes thermal transfer based on the output thermal transfer data. Specifically, the controller 50 drives the X-axis feed motor and the Y-axis scanning motor to move the process object 44 and the thermal transfer tool 30 relative to each other. For example, based on the thermal transfer data, the controller 50 disposes the thermal transfer tool 30 above a predetermined position of the process object 44. The controller 50 drives the Y-axis scanning motor, and moves the thermal transfer tool 30 in the main scanning direction Y relative to the process object 44 based on the thermal transfer data. At the same time, based on the thermal transfer data, the controller 50 drives the electromagnetic actuator at a predetermined timing so that the pressing body 36 of the thermal transfer tool 30 is pressed against and separated from the surface of the process object 44. In addition, based on the thermal transfer data, the controller 50 actuates the light source 32 at a predetermined timing so that laser light is emitted from the light exit portion 36*b* of the thermal transfer tool 30 toward the process object 44.

At this time, in a portion of the process object 44 irradiated with laser light, the process object 44 absorbs the laser light and converts the laser light to thermal energy. The conversion from optical energy to thermal energy is performed in at least one of the transfer object 42, the base material, the decorative layer, and the adhesive layer of the thermal transfer sheet 43 and, in the case of including a light absorbing sheet, the light absorbing sheet in the process object 44. In a case where the adhesive layer absorbs laser light by itself, the adhesive layer is directly heated. In a case where one of the transfer object 42, the base material, the decorative layer, and the light absorbing sheet except for the adhesive layer absorbs laser light, the material that has absorbed laser light generates heat and the heat is conducted to the adhesive layer. Accordingly, the adhesive layer is softened and comes to have an adhesive property. The adhesive layer is adhered to the decorative layer and the surface of the transfer object 42. Thereafter, the thermal transfer tool 30 moves or light irradiation stops, and thus, supply of optical energy to this irradiated portion is finished. Then, the adhesive layer is cooled by heat dissipation to be hardened. Accordingly, the decorative layer and the surface of the transfer object 42 are fixed and bonded together. Subsequently, the user removes the base material of the thermal transfer sheet 43 from the surface of the transfer object 42, thus obtaining a transfer object product in which a desired pattern, for example, is thermally transferred onto the surface of the transfer object 42.

In the manner described above, in the thermal transfer apparatus 1 according to this preferred embodiment, the pressing body 36 included in the thermal transfer tool 30 projects downward D from the holder 38 (pen body 31). At least the light exit portion 36*b* of the pressing body 36 includes a curved surface projecting in the direction from the light entrance portion 36*a* toward the light exit portion 36*b*. Accordingly, as compared to a case where the pressing body 36 is defined by a plate-shaped member including a corner portion, the contact area between the pressing body 36 and the process object 44 is small. Accordingly, even in a case where the surface of the process object 44 has unevenness, the light exit portion 36*b* is able to press the surface following the uneven surface. Consequently, the uneven surface of the process object 44 is able to be uniformly pressed so that transfer variations, for example, are reduced or eliminated. In addition, since the pressing body 36 has no corner portions, when the thermal transfer tool 30 moves in the main scanning direction Y, the process object 44 is not caught in the pressing body 36 so that the thermal transfer tool 30 is able to move smoothly while pressing the surface of the process object 44.

In this preferred embodiment, the vertical slider mechanism 24 is able to control the position of the thermal transfer tool 30 in the Z-axis direction, for example. Accordingly, the distance between the thermal transfer tool 30 and the process object 44 before actuation of the electromagnetic actuator are able to be adjusted. Thus, the thermal transfer tool 30 is able to adjust the degree of pressing to the process object 44 when the electromagnetic actuator is actuated, and the degree of the pressing is able to be continuously changed as intended. Here, in this preferred embodiment, the curved surface of the light exit portion 36*b* is a hemispherical surface. Thus, only by changing the degree of pressing, the contact area between the pressing body 36 and the process object 44 is able to be changed. As a result, a line width in pressing the process object 44 is able to be adjusted. In particular, it is possible to reduce the line width of a pressing line by the pressing body 36 when the pressing body 36 and the process object 44 are moved relative to each other with the process object 44 being pressed.

In this preferred embodiment, the pressing body 36 is a sphere. The light entrance portion 36*a* and the light exit portion 36*b* of the pressing body 36 are able to show a lens action. Accordingly, the laser diameter is able to be converted without a change in the optical path L of laser light. Thus, the process object 44 is able to be efficiently heated with less optical energy. In addition, a portion irradiated with light is able to be made smaller than the contact area between the pressing body 36 and the process object 44. As a result, it is possible to reduce or prevent a problem that after optical energy is converted to thermal energy in the process object 44, heat generated in the process object 44 is conducted to the surroundings so that the heated area becomes larger than the pressed area.

In some types of a so-called thermal stylus that heats the pressing body itself and supplies heat to the process object 44, in order to efficiently and smoothly supply heat from the pressing body to the process object 44, the pressing body preferably has a ball shape so that the pressing body rotates in scanning with the thermal stylus. On the other hand, the thermal transfer tool 30 disclosed here supplies optical energy to the process object 44 and converts optical energy to thermal energy in the process object 44. Thus, the pressing body 36 itself is not heated. Thus, the pressing body 36 does not rotate in scanning the thermal transfer tool 30. The pressing body 36 may be rotatable or may not be rotatable, in scanning with the thermal transfer tool 30. In a case where the pressing body 36 does not rotate in the bottom portion 38*e*, the projection positions of the first projecting wall portions 38*a* and 38*b* and the second projecting wall portions 38*c* and 38*d* and the taper angle, for example, are adjusted in such a manner that the first projecting wall portions 38*a* and 38*b* and the second projecting wall portions 38*c* and 38*d* pinch the pressing body 36 while pressing the pressing body 36, for example. Accordingly, rotation of the pressing body 36 is able to be inhibited by the first projecting wall portions 38*a* and 38*b* and the second projecting wall portions 38*c* and 38*d*.

In this preferred embodiment, the bottom portion 38*e* that is the front end portion of the pen body 31 has the aperture P that is the through hole located on the center axis O of the pen body 31, and the front end portion of the pen body 31 has an inner wall surrounding the through hole. A portion of the pressing body 36 is disposed inside the through hole and is in contact with the inner wall. At least a portion of the curved surface of the pressing body 36 is located outside the through hole. This configuration enables the holder 38 to stably fix the pressing body 36 to the front end portion of the thermal transfer tool 30 without using a composition such as an adhesive. Accordingly, in a case where the pressing body 36 is made of a material having a smooth surface, such as glass, or a case where the pressing body 36 has a shape that easily rotates and is not easily held, such as a sphere, for example, the holder 38 is able to stably hold the pressing body 36 irrespective of the shape, the material, and so forth.

For example, the pressing body 36 of a glass sphere is able to be fixed to the front end portion of the holder 38 with an adhesive. In this case, however, even when the sphere and the holder are brought into contact with each other with an adhesive, the sphere might rotate before the adhesive is cured in some cases. Then, the adhesive is spread over the surface of the sphere so that a small amount of the adhesive contributes to the adhesion. In addition, there can also arise drawbacks such as a drawback in which the adhesive is attached to the light entrance portion 36*a* or the light exit portion 36*b* of the pressing body 36 to cause scattering of laser light and a drawback in which the adhesive itself degrades under the influence of laser light to cause detachment of the pressing body 36. On the other hand, in this preferred embodiment, the pressing body 36 is pinched between the first projecting wall portions 38*a* and 38*b* and the second projecting wall portions 38*c* and 38*d* of the inner wall. The front end portion of the pen body 31 does not include an adhesion portion that bonds the pressing body 36 and the inner wall. Accordingly, the thermal transfer tool 30 disclosed herein avoids drawbacks derived from the use of an adhesive.

In this preferred embodiment, the inner wall surrounding the aperture P includes the first projecting wall portions 38*a* and 38*b* whose inner diameters increase toward the front end of the pen body 31 in a first vertical cross section (see FIG. 3D) passing through the center axis O of the pen body 31. The inner wall also includes the second projecting wall portions 38*c* and 38*d* whose inner diameters decrease toward the front end of the pen body 31 in a second vertical cross section (see FIG. 3E) passing through the center axis O of the pen body 31. Accordingly, the first projecting wall portions 38*a* and 38*b* and the second projecting wall portions 38*c* and 38*d* are able to pinch the pressing body 36 in balance with the surfaces tilted relative to the center axis O.

The first vertical cross section and the second vertical cross section are perpendicular or substantially perpendicular to each other. Accordingly, the first projecting wall portions 38*a* and 38*b* and the second projecting wall portions 38*c* and 38*d* support the pressing body 36 in better balance at four sides toward the center axis O or the barycenter of the pressing body 36. Thus, even when the process object 44 is pressed during scanning with the thermal transfer tool 30, wobbling of the pressing body 36 and movement of the pressing body 36 in the space Q is significantly reduced or prevented.

In this preferred embodiment, the first projecting wall portions 38*a* and 38*b* include two or more projecting pieces projecting along surfaces perpendicular or substantially perpendicular to the axial direction from two or more locations on the inner wall of the cylindrical portion. Accordingly, for example, in the bottom portion 38*e* of the ferrule holding portion 38*f*, a gap is provided along the radial direction between the projecting wall portion 38*a* and the projecting wall portion 38*b*. The second projecting wall portions 38*c* and 38*d* include two or more projecting pieces projecting along surfaces perpendicular or substantially perpendicular to the axial direction from two or more locations on the inner wall of the cylindrical portion. Accordingly, in the bottom portion 38*e* of the ferrule holding portion 38*f*, for example, a gap (aperture P) is provided in the radial direction between the projecting wall portion 38*c* and the projecting wall portion 38*d*. The holder 38 is preferably made of elastic polyacetal. With this configuration, when the pressing body 36 fixed to the holder 38 is removed from the holder 38, a rod-shaped push member is able to be easily inserted from the side of the ferrule holding portion 38*f* toward the pressing body 36. In addition, pushing of the pressing body 36 with the push member enables the projecting wall portion 38*c* and the projecting wall portion 38*d* to be easily bent downward D. Consequently, the pressing body 36 is able to be taken out of the pen body 31 through an enlarged gap between the projecting wall portion 38*c* and the projecting wall portion 38*d*. In other words, the pressing body 36 is able to be easily detached from the holder 38 by a one-touch operation (single operation).

Similarly, in housing the pressing body 36 in the space Q in the projecting portion 38*g*, the pressing body 36 is pressed against the second projecting wall portions 38*c* and 38*d* at the lower end of the pen body 31. Accordingly, the projecting wall portions 38*c* and 38*d* is able to be bent inward of the space Q. Thus, a gap between the projecting wall portion 38*c* and the projecting wall portion 38*d* is enlarged so that the pressing body 36 is able to pass through the gap. As a result, the pressing body 36 is able to be fixed to the holder 38 by a one-touch operation (single operation).

With the foregoing configuration, the pressing body 36 is able to be easily attached to the holder 38, and is able to be easily detached from the holder 38. Accordingly, in a case where the pressing body 36 is scratched or damaged with the use of the thermal transfer tool 30, for example, the pressing body 36 is able to be easily replaced with another one. In this manner, the thermal transfer tool 30 showing excellent maintainability is able to be provided. It is unnecessary to make the holder 38 capable of being disassembled in order to detach and detach the pressing body 36. As a result, the holder 38 is able to be formed integrally, and thus, the number of components is able to be reduced.

In this preferred embodiment, the first projecting wall portions 38*a* and 38*b* are defined by the two projecting pieces projecting from the inner wall of the cylindrical portion. However, the state of the projection pieces of the first projection portions of the holder 38 is not limited to this example. For example, the projecting pieces of the first projection portion may have a doughnut shape projecting from the entire periphery of the inner wall of the cylindrical portion. Alternatively, the projecting pieces of the first projecting wall portions may include three, four, or five or more projecting pieces projecting from the inner wall of the cylindrical portion. In a case where the holder 38 includes two or more projecting pieces as the first projecting wall portions, these projecting pieces are preferably evenly dispersed (arranged at regular intervals) circumferentially, for example. In this case, the depth of the ferrule holding portion 38*f* is able to be restricted, and the pressing body 36 is able to be firmly held by the holder 38.

In addition, in this preferred embodiment, the second projecting wall portions 38*c* and 38*d* are defined by the two projecting pieces projecting from the inner wall of the cylindrical portion. However, the state of the projection pieces of the second projection portions of the holder 38 is not limited to this example. For example, the projecting pieces of the second projection portion may have a doughnut shape projecting from the entire periphery of the inner wall of the cylindrical portion. In this case, inner end portions of the doughnut-shaped projecting pieces are preferably made of a flexible material. Alternatively, the projecting pieces of the second projecting wall portions may be three, four, or five or more projecting pieces projecting from the inner wall of the cylindrical portion. In a case where the holder 38 includes two or more projecting piece as the second projecting wall portions, these projecting pieces are preferably evenly dispersed (arranged at regular intervals) circumferentially, for example. Accordingly, the pressing body 36 is also able to be firmly held by the holder 38.

Furthermore, in this preferred embodiment, each of the first projecting wall portions 38*a* and 38*b* and the second projecting wall portions 38*c* and 38*d* is disposed in the entire thickness direction of the bottom portion 38*e*. However, the state of the projecting wall portions 38*a*, 38*b*, 38*c*, and 38*d* is not limited to this example. The projecting wall portions 38*a*, 38*b*, 38*c*, and 38*d* may be disposed only in a portion of the thickness direction of the bottom portion 38*e* independently of each other or in cooperation. For example, the aperture P may include one or more tapered portions (projecting wall portions) having relatively steep taper angles in a portion of cylindrical space having a radius R1.

Figure 4:
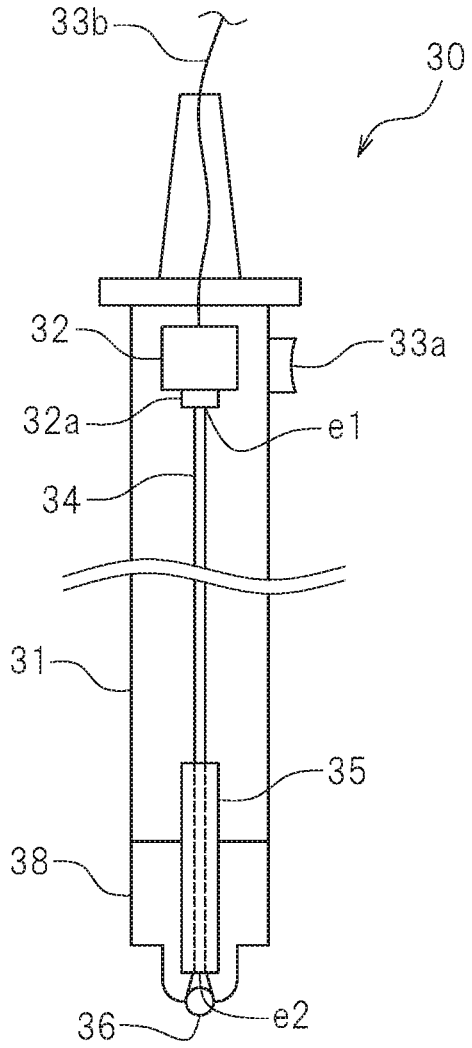
FIG. 4 is a schematic view illustrating a configuration of a thermal transfer light pen according to a preferred embodiment of the present invention.

In this preferred embodiment, the thermal transfer tool 30 is included in the thermal transfer apparatus 1, and is used as a component of the thermal transfer apparatus 1. The thermal transfer tool 30, however, is not necessarily included in the thermal transfer apparatus 1, and may be used alone. In this case, as illustrated in FIG. 4, for example, the light source 32, the solenoid electromagnetic actuator (not shown), and the spring (not shown) can be housed in the pen body 31. The pen body 31 may additionally include a switch 33*a* that controls driving of the light source 32 and the electromagnetic actuator independently of each other or at the same time, and a power code 33*b* connected to the light source 32 and the electromagnetic actuator and used to supply electric power to the light source 32 and the electromagnetic actuator. In this case, application of light and pressing by the thermal transfer tool 30 alone is also able to be achieved. As a result, for example, the user is able to perform thermal transfer by holding the thermal transfer tool 30 and scanning with the thermal transfer tool 30 by himself/herself.

The foregoing description is directed to the preferred embodiments of the present invention. The preferred embodiments described above, however, are merely examples, and the present invention can be performed in various modes.

In the above preferred embodiments, the light source 32 preferably includes an LD that oscillates laser light. Here, the light source 32 may be a device that generates so-called light rays such as infrared rays, visible rays, and ultraviolet rays. The light source 32 may be various types of devices that generate electromagnetic waves including electric waves such as microwaves at frequencies lower than those of light rays. For example, in a case where the process object 44 is made of a material having a predetermined natural frequency corresponding to the number of vibrations of infrared rays (electromagnetic waves), intermolecular motion is stimulated by infrared rays so that heat is generated. In general, nonmetal materials such as ceramic materials, resin materials, paper, and wood have high radiativities (absorptances) of infrared light and far infrared light having wavelengths of about 1 μm or more. Accordingly, in a case where the process object 44 such as the transfer object 42 or the thermal transfer sheet 43 (especially the adhesive layer) includes these materials, the light source 32 may generate infrared light rays near 1064 nm, far infrared light rays having a wavelength band of about 3 μm or more (e.g., about 3 μm or more and about 1000 μm or less), and other light rays, for example. On the other hand, as the wavelength of light increases, the absorptance of a metal material to the light decreases, and thus, heating by far infrared rays is not effective. In a case where the process object 44 includes a metal material and this metal material is intended to be heated, the light source 32 preferably generates near-infrared rays in a wavelength band of about 3 μm or less or visible rays, for example. For example, an example of the light source 32 that generates near-infrared rays is a halogen lamp.

Light generated by the light source 32 is not limited to specific light, but is preferably laser light source showing excellent directivity and excellent convergence and having a uniformly maintained wavelength. Thus, the light source 32 preferably includes a laser oscillation device that generates laser light having the wavelengths described above. In this preferred embodiment, the light source 32 includes an LD. A laser generation medium in this LD is not specifically limited. The medium used to generate laser light may be any one of semiconductors such as GaAs and InGaAsP, solid materials such as ruby, glass, yttrium aluminum garnet (YAG), gases such as $CO_2$, Ar, and He—Ne, and liquid such as organic coloring matter.

Figure 5:
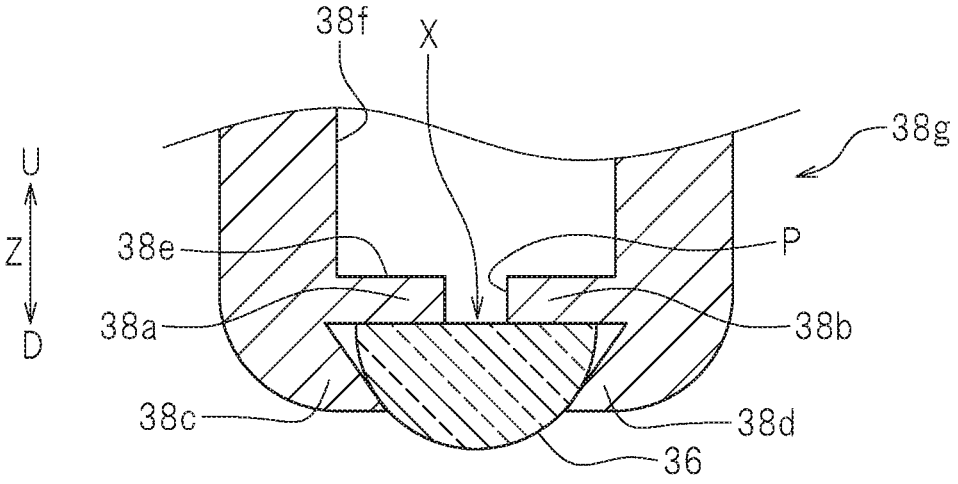
FIG. 5 is a partial cross-sectional view schematically illustrating arrangement of a holder and a pressing body according to another preferred embodiment of the present invention.

In the preferred embodiments described above, the pressing body 36 preferably is a sphere. The pressing body 36, however, is not limited to a specific shape as long as the shape of the light exit portion 36*b* includes a curved surface. For example, as illustrated in FIG. 5, the pressing body 36 may be a hemisphere oriented to project downward D in the vertical direction Z. With this configuration, the pressing body 36 is able to be held stably without providing tapers in the projecting wall portions 38*a* and 38*b*.

In the present preferred embodiment, the process object 44 is moved in the X-axis direction, and the thermal transfer tool 30 is moved in the Y-axial direction and the Z-axis direction. However, the present invention is not limited to this example. For example, the thermal transfer apparatus 1 may move only the process object 44 relative to the thermal transfer tool 30 and may move only the thermal transfer tool 30 relative to the process object 44.

In the preferred embodiments described above, the thermal transfer apparatus 1 does not include a close contact mechanism to bring the transfer object 42, the thermal transfer sheet 43, and when necessary, the light absorbing sheet of the process object 44 in close contact with each other. Alternatively, the thermal transfer apparatus 1 may include a known close contact mechanism such as an electrostatic attraction mechanism or an air attraction mechanism, and such close contact mechanisms can be used in thermal transfer.

The terms and expressions used herein are for description only and are not to be interpreted in a limited sense. These terms and expressions should be recognized as not excluding any equivalents to the elements shown and described herein and as allowing any modification encompassed in the scope of the claims. The present invention may be embodied in many various forms. This disclosure should be regarded as providing preferred embodiments of the principles of the present invention. These preferred embodiments are provided with the understanding that they are not intended to limit the present invention to the preferred embodiments described in the specification and/or shown in the drawings. The present invention is not limited to the preferred embodiments described herein. The present invention encompasses any of preferred embodiments including equivalent elements, modifications, deletions, combinations, improvements and/or alterations which can be recognized by a person of ordinary skill in the art based on the disclosure. The elements of each claim should be interpreted broadly based on the terms used in the claim, and should not be limited to any of the preferred embodiments described in this specification or referred to during the prosecution of the present application.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A thermal transfer light pen comprising:

a hollow pen body including a front end portion;

a pressing body disposed in the front end portion of the pen body and including a curved surface projecting toward a front end;

a light guide including a first end and a second end, at least a portion of the light guide being disposed inside the pen body; and a light source connected to the first end of the light guide; wherein the second end of the light guide is disposed in the pen body and faces the pressing body at the front end portion of the pen body;

the pressing body is made of a material transparent to light emitted from the light source;

the front end portion of the pen body includes a through hole located on a center axis of the pen body;

the front end portion of the pen body includes an inner wall surrounding the through hole;

a portion of the pressing body is disposed inside the through hole and in contact with the inner wall;

at least a portion of the curved surface of the pressing body is located outside the through hole; and the inner wall includes a first projecting wall portion with an inner diameter that increases toward the front end of the pen body in a first vertical cross section passing through the center axis of the pen body, and also includes a second projecting wall portion with an inner diameter that decreases toward the front end of the pen body in a second vertical cross section passing through the center axis of the pen body.

2. The thermal transfer light pen according to claim 1, wherein the curved surface is a hemispherical surface.

3. The thermal transfer light pen according to claim 2, wherein the pressing body is spherical.

4. The thermal transfer light pen according to claim 2, wherein the pressing body is hemispherical.

5. The thermal transfer light pen according to claim 1, wherein the first vertical cross section and the second vertical cross section are perpendicular or substantially perpendicular to each other.

6. The thermal transfer light pen according to claim 1, wherein the pressing body is pinched between the first projecting wall portion and the second projecting wall portion of the inner wall; and the front end portion of the pen body does not include an adhesion portion that bonds the pressing body and the inner wall to each other.

7. The thermal transfer light pen according to claim 1, wherein at least the front end portion of the pen body is made of an elastically deformable material.

8. The thermal transfer light pen according to claim 1, wherein the pressing body is made of glass.

9. A thermal transfer apparatus comprising:

the thermal transfer light pen according to claim 1;

a placing table on which a transfer object is placed;

a conveyor that moves the placing table and the thermal transfer light pen relative to each other; and a controller that is connected to the light source provided in the thermal transfer light pen and the conveyor to enable communication with the light source and the conveyor, and drives the light source and the conveyor; wherein the controller causes the thermal transfer light pen and the placing table to be moved relative to each other by the conveyor so that the pressing body of the thermal transfer light pen is pressed against the transfer object and to supply light from the light source of the thermal transfer light pen onto the transfer object.

* * * * *